US008721002B2

(12) United States Patent
Smith

(10) Patent No.: US 8,721,002 B2
(45) Date of Patent: May 13, 2014

(54) SEATING DEVICE WITH ERGONOMIC ARMRESTS

(76) Inventor: Laura Lisa Smith, New York, NY (US)

( * ) Notice: Subject to any disclaimer, the term of this patent is extended or adjusted under 35 U.S.C. 154(b) by 303 days.

(21) Appl. No.: 12/815,131

(22) Filed: Jun. 14, 2010

(65) Prior Publication Data

US 2010/0314923 A1 Dec. 16, 2010

Related U.S. Application Data

(60) Provisional application No. 61/186,583, filed on Jun. 12, 2009.

(51) Int. Cl.

| | |
|---|---|
| ***A47C 7/54*** | (2006.01) |
| ***A47C 7/40*** | (2006.01) |
| ***A47C 3/04*** | (2006.01) |

(52) U.S. Cl.
USPC ..... 297/411.43; 297/411.2; 297/239

(58) Field of Classification Search
USPC ..... 297/411.2, 411.4, 411.41, 411.43, 297/411.44, 440.23, 452.63, 239
See application file for complete search history.

(56) References Cited

U.S. PATENT DOCUMENTS

| | | | | | |
|---|---|---|---|---|---|
| 2,307,138 | A | * | 1/1943 | Kraeft | 297/411.4 |
| 3,027,195 | A | * | 3/1962 | Nelson et al. | 297/411.41 |
| 4,022,502 | A | * | 5/1977 | Smith et al. | 297/411.23 |
| 4,456,296 | A | * | 6/1984 | Rowland | 297/239 |
| D335,587 | S | * | 5/1993 | Backer | D6/379 |
| D341,264 | S | * | 11/1993 | Gehry | D6/370 |
| 6,805,412 | B2 | * | 10/2004 | Roth | 297/452.2 |
| 6,857,138 | B2 | * | 2/2005 | Moser et al. | 4/237 |
| 7,066,553 | B2 | * | 6/2006 | Maloney | 297/452.63 |
| D524,072 | S | * | 7/2006 | King | D6/380 |
| D534,006 | S | * | 12/2006 | Tseng | D6/376 |
| D540,057 | S | * | 4/2007 | Doughty | D6/370 |
| D564,249 | S | * | 3/2008 | Kriess | D6/379 |
| D579,226 | S | * | 10/2008 | Pinaffo et al. | D6/379 |

OTHER PUBLICATIONS

Laura Lisa Smith, Declaration of Inventor for U.S. Appl. No. 12/815,131, Entitled "Seating Device With Ergonomic Armrest," dated Dec. 18, 2013, 21 pages, New York.

* cited by examiner

*Primary Examiner* — David R Dunn
*Assistant Examiner* — Tania Abraham
(74) *Attorney, Agent, or Firm* — Alston & Bird LLP

(57) ABSTRACT

Various embodiments of the present invention provide seating devices having an armrest with a triangular cross-section that twists along its length to provide a support surface with increased comfort to the occupant, in addition to making the chair strong and durable. The seating device of the present invention may also be stackable.

15 Claims, 9 Drawing Sheets

SEATING DEVICE WITH ERGONOMIC ARMRESTS

CROSS REFERENCES TO RELATED APPLICATIONS

This application claims priority from U.S. Provisional Application No. 61/186,583 filed on Jun. 12, 2009, which is incorporated by reference herein, in its entirety.

FIELD OF INVENTION

The present invention relates in general to devices for supporting the weight of a person in a seated position. More particularly, embodiments of the present invention relate to seating devices with armrests having a novel arm support surface that twists along the length of the armrests.

BACKGROUND OF THE INVENTION

The prior art is replete with chairs. Indeed, lightweight stackable chairs have been in existence for many years. Such prior art chairs come in a variety of shapes and sizes. Common to most prior art chairs is an armrest that includes a flat, planar surface that is substantially perpendicular to the back of the chair. The armrests typically have a rectangular cross-section, which facilitates joining of the armrest to the back of the chair. Although a rectangular cross-section armrest can provide a strong joint between the arm and the back of the chair, or the arm and the seat or leg of the chair, this arrangement forces the occupant's forearm to lie at a 90 degree angle, which can be uncomfortable.

Moreover, a useful component of a chair is its ability to stack. Stackable chairs are ideal for storage because they reduce the space required to house unused chairs. Stackable chairs are further optimal when moving a large number of chairs as it allows for several chairs to be relocated at one time. However, chairs with unique arm structures are frequently unable to effectively stack because the arm structure prevents clean alignment of the chairs.

Accordingly, there is a need in the industry for a seating device with improved armrest designs that provide better ergonomics while also facilitating strong apparatus construction and stackability.

SUMMARY OF THE INVENTION

Embodiments of the present invention provide a device for supporting the weight of a person in a seated position. More specifically, various embodiments provide a seating device that includes at least one armrest having a support surface that changes orientation along the length of the armrest.

In one embodiment, a seating device is provided. The seating device includes a pair of front legs; a pair of rear legs; a seat portion mounted to the pairs of front legs and rear legs; a back disposed between the pair of rear legs; and at least one armrest. The armrest is attached proximate a first end to a respective front leg, which is selected from the pair of front legs and attached proximate a second end to a respective rear leg, which is selected from the pair of rear legs. The armrest has a triangular cross-section and a twist extending the length of the armrest such that an arm support surface configured to support the arm of an occupant has a first orientation proximate the respective rear leg and a second orientation proximate the respective front leg. The first orientation includes the support surface facing away from the respective rear leg and inclined relative to the respective rear leg.

In a second embodiment another seating device is provided. The seating device includes a pair of front legs; a pair of rear legs; a seat portion mounted to the pairs of front legs and rear legs; a back disposed between the pair of rear legs; and at least one armrest. The armrest is attached proximate a first end to a respective front leg, which is selected from the pair of front legs and attached proximate a second end to a respective rear leg, which is selected from the pair of rear legs. The armrest has an arm support surface configured to support the arm of an occupant, where the support surface includes a twist such that the support surface has a first orientation proximate the respective rear leg and a second orientation proximate the respective front leg. The first orientation includes the support surface facing away from the respective rear leg and inclined relative to the respective rear leg.

BRIEF DESCRIPTION OF THE DRAWINGS

Having thus described the invention in general terms, reference will now be made to the accompanying drawings, which are not necessarily drawn to scale.

Figure 1:
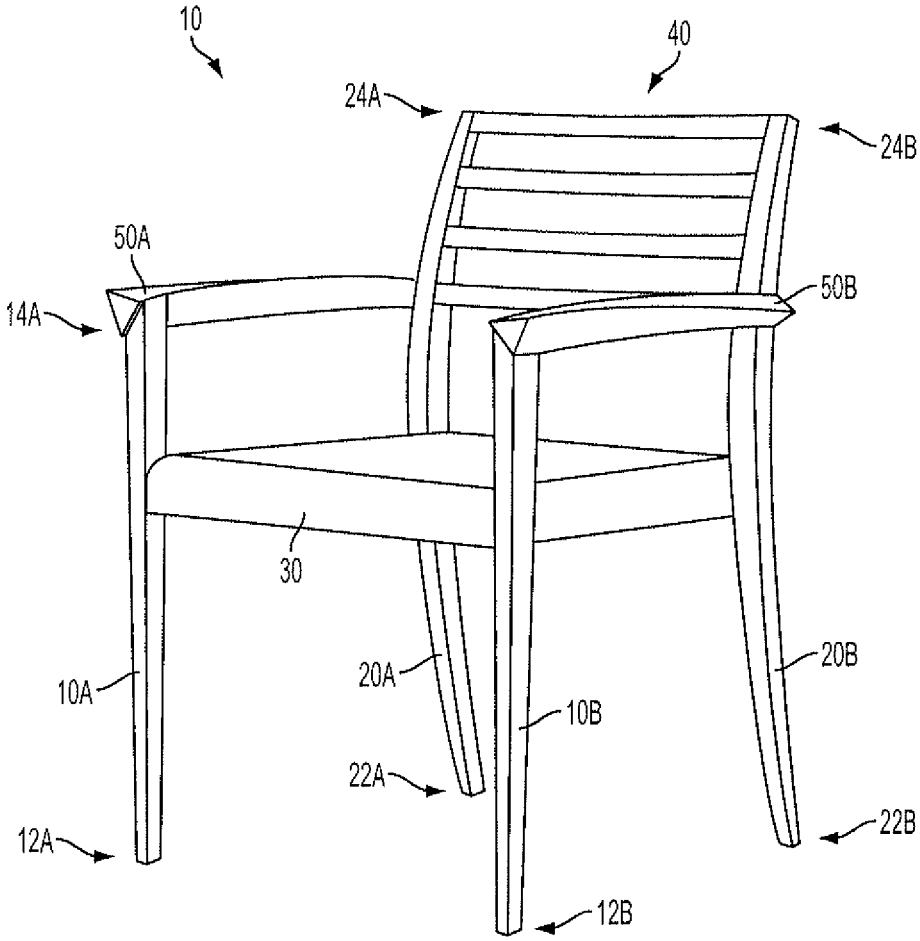

FIG. 1 is a diagram illustrating a seating device having a horizontal slat back in accordance with an embodiment of the present invention.

Figure 2:
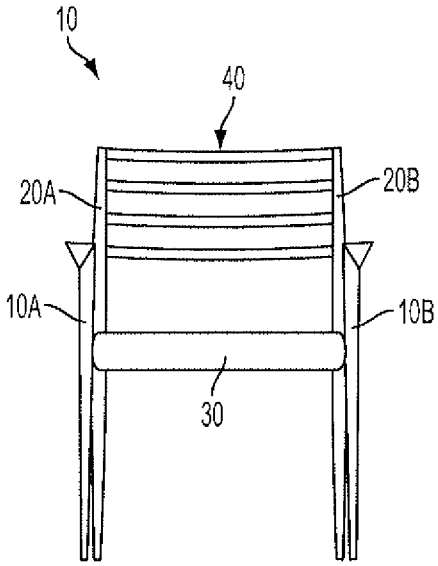

FIG. 2 is a front view of the seating device illustrated in FIG. 1.

Figure 3:
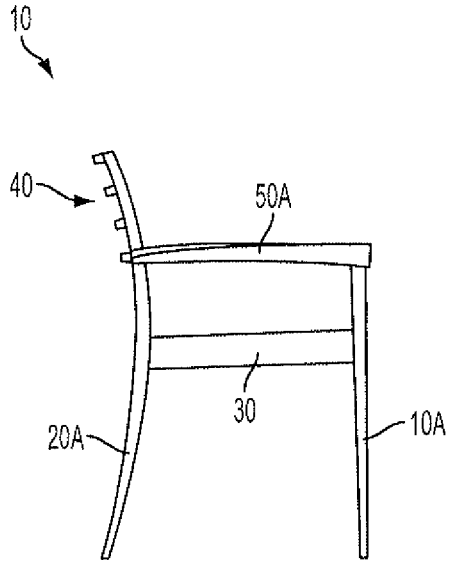

FIG. 3 is a side view of the seating device illustrated in FIG. 1.

Figure 4:
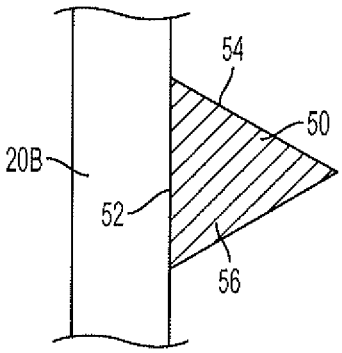

FIG. 4 is a partial front view of a joint formed by a triangular armrest and a rear leg in accordance with an embodiment of the present invention.

Figure 5:
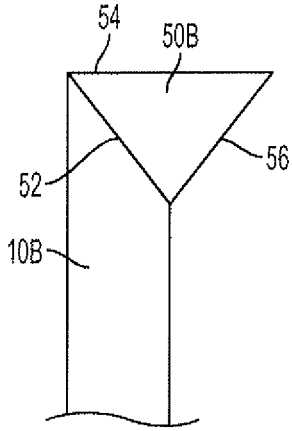

FIG. 5 is a partial front view of a joint formed by a triangular armrest and a front leg in accordance with an embodiment of the present invention.

Figure 6A:
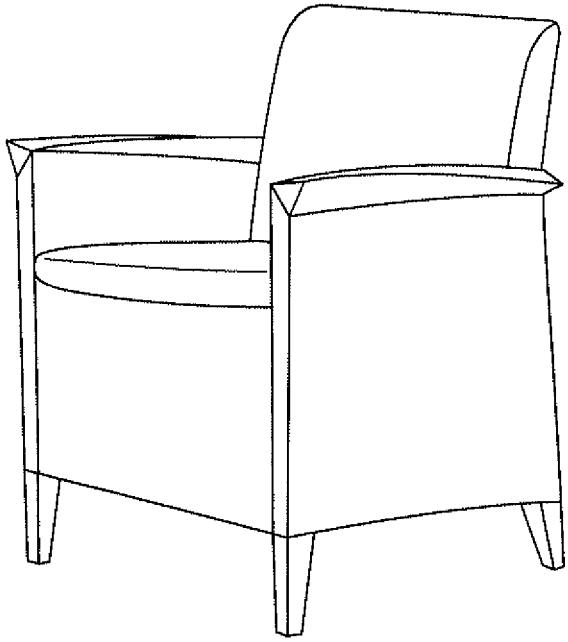
Figure 6B:
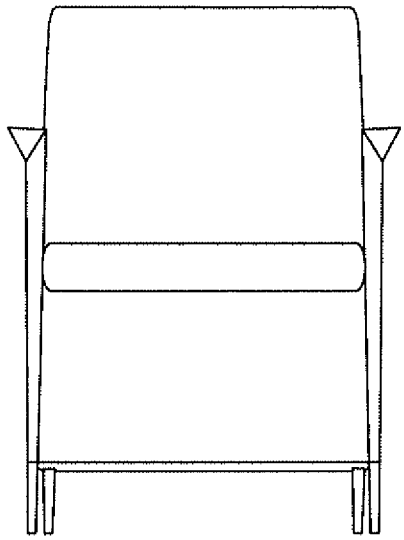
Figure 6C:
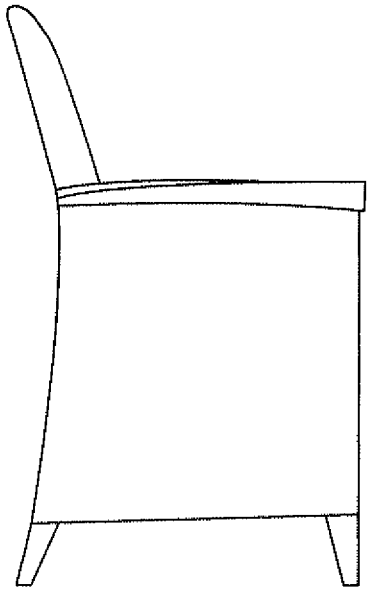

FIGS. 6A-C illustrate a lounge chair in accordance with an embodiment of the present invention.

Figure 7A:
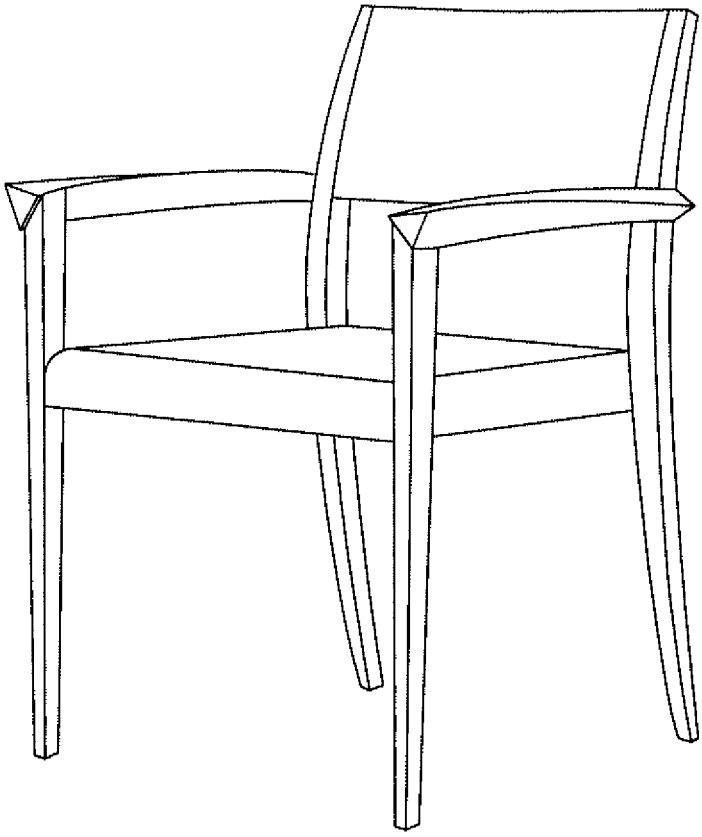
Figure 7B:
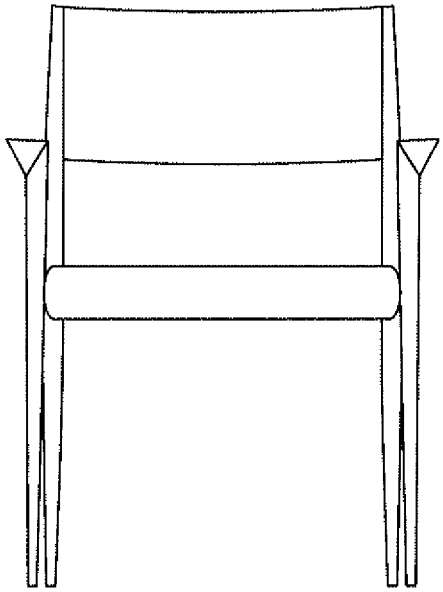
Figure 7C:
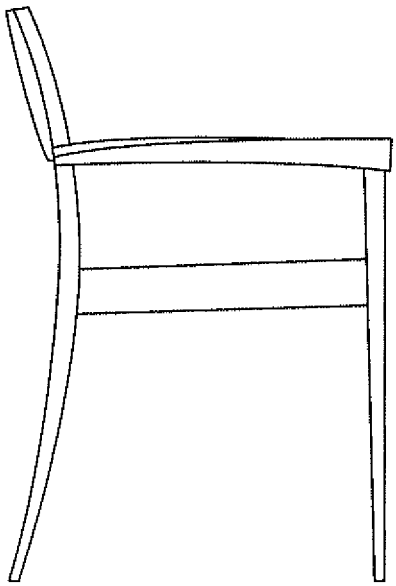

FIGS. 7A-C illustrate a seating device with an upholstered back in accordance with an embodiment of the present invention.

Figure 8A:
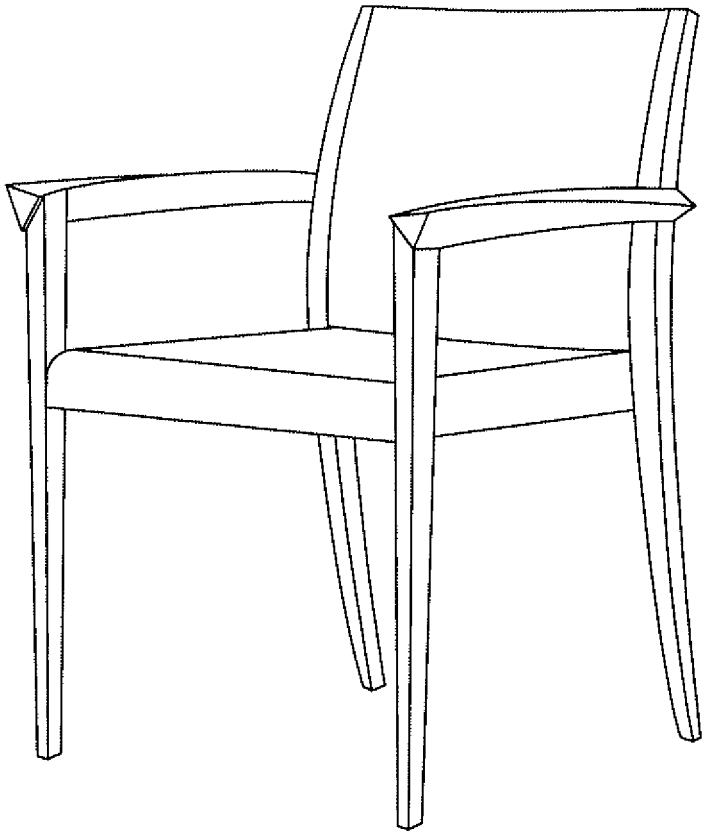
Figure 8B:
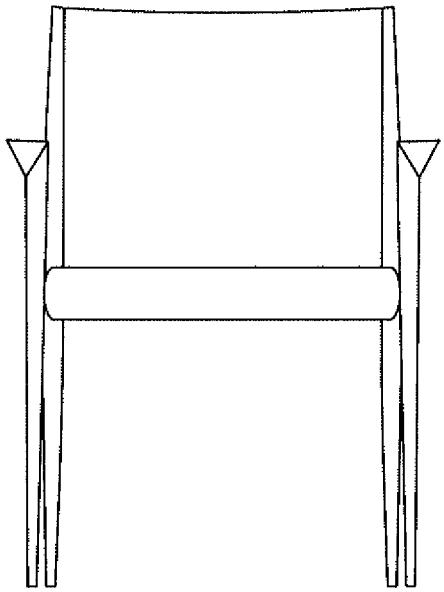
Figure 8C:
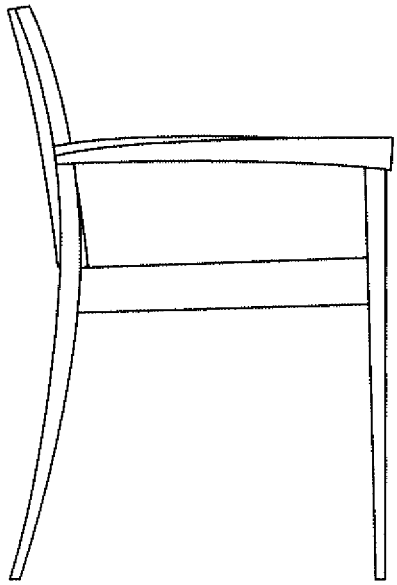

FIGS. 8A-C illustrate a seating device with an upholstered back in accordance with another embodiment of the present invention.

Figure 9:
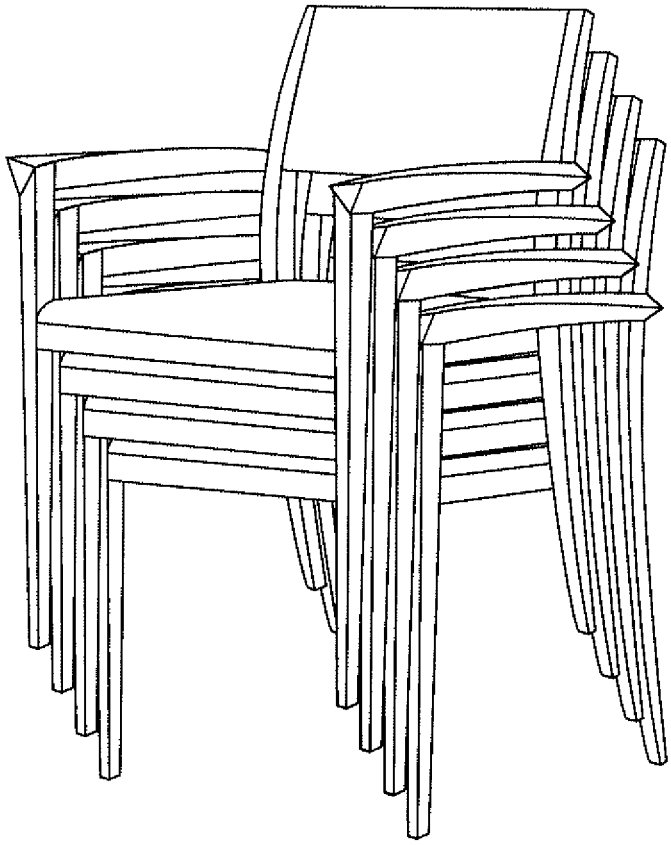

FIG. 9 illustrates a stack of several seating devices in accordance with an embodiment of the present invention.

DETAILED DESCRIPTION OF THE INVENTION

The present invention now will be described more fully hereinafter with reference to the accompanying drawings, in which some, but not all embodiments of the invention are shown. Any embodiment described is only an example of one embodiment and should not be interpreted to limit any of the claims. Like numbers refer to like elements throughout.

Embodiments of the present invention provide a device for supporting the weight of a person in a seated position. More specifically, various embodiments provide a seating device that includes at least one armrest having an arm support surface that changes orientation along the length of the armrest. It has been discovered that the armrest of this design provides improved comfort. This may be attributed to the fact that the armrest support surface is not planar, but rather twists from the back of the seating device to the front of the seating device. Proximate the back of the seating device, an occupant's arm would rest on an outwardly facing and downward sloping support surface in various embodiments of the present invention. As the armrest extends toward the front of the seating device, the armrest support surface becomes more flat (e.g., more parallel with a supporting surface for the seating device). In various embodiments, the armrest support surface proximate the front end of the armrest is substantially perpendicular to the longitudinal axis of the front legs and/or parallel with the seat portion. This structure of the armrest is consistent with the normal relaxed position of an occupant's arm. When an occupant is sitting in the seating device, less pressure is applied to the elbow as compared to a standard flat planar armrest.

For ease of understanding, various features of the present invention will be described in the context of a chair having an armrest with a triangular cross-section. It should be understood that various aspects of the present invention could be applied to other seating devices with cross-sections other than triangular.

FIGS. 1-3 illustrate a chair 10 in accordance with an embodiment of the present invention. The illustrated embodiment is a horizontal slat back chair 10 that includes a pair of front legs 10A-B, a pair of rear legs 20A-B, a seat portion 30, a back portion 40, and two triangular armrests 50A-B.

The front and rear legs 10A-B, 20A-B are elongate structures having generally rectangular cross-sections. The front legs 10A-B each include a first end 12A-B configured to engage a support surface and a second end 14A-B configured to support a respective armrest 50A-B. Similarly, the rear legs 20A-B each include a first end 22A-B configured to engage a support surface and a second end 24A-B for supporting the back portion 40. In the illustrated embodiment, the longitudinal axes of the front and rear legs 10A-B, 20AB are substantially parallel to a front-to-back plane.

In the illustrated embodiment, the front legs 10A-B are substantially straight with a slight taper. The rear legs 20A-B have an arcuate shape as illustrated in FIG. 3 and also include a slight taper. It should be understood that the front and rear legs in other embodiments may be straight, arcuate or have other desired shapes. Additionally, the front and rear legs may also have cross-sections other than rectangular and may or may not have tapered portions along their length.

The seat portion 30 is a substantially planar component that is attached to each of the front legs 10A-B intermediate the respective first and second ends 12A-B, 14 A-B and the rear legs 20A-B intermediate the respective first and second ends 22A-B, 24 A-B. The seat portion 30 may be attached using any known attachment methods such as, for example, joinery using dowels, dovetail joints, screws, or screws with threaded inserts.

In various embodiments, the seat portion 30 is attached to the legs 10A-B, 20A-B such that in use, the seat portion 30 is substantially parallel with the support surface when the first ends 12A-B, 22A-B of the legs 10A-B, 20A-B engage the support surface. In other embodiments, the seat portion 30 may have a slight incline relative to the support surface. Additionally, the seat portion 30 may also be contoured for comfort and/or may be upholstered.

The back portion 40 is attached to the rear legs 20A-B proximate the respective second ends 24A-B. In the illustrated embodiment, the back portion 40 comprises four slats extending between the rear legs 20A-B. It should be understood that the back portion 40 may comprise any number of slats and may be upholstered for comfort as illustrated in FIGS. 7A-C and 8A-C. Additionally, as is illustrated in FIG. 3, the back portion 4 of the chair may tilt rearward as a result of the arcuate shape of the rear legs 20A-B. In this embodiment, the back portion 40 is curved to provide specific support for a lower portion of the back of a seated occupant. It should be noted that the back portion 40 in other embodiments may not be tilted rearward. In further embodiments, the back portion may be spaced apart from the seat portion as illustrated in FIGS. 1-3 and 7A-C or may extend to the seat portion as illustrated in FIGS. 8A-C.

In various embodiments, the armrests 50A-B are elongate structures with a substantially triangular cross-section. As illustrated, the armrests 50A-B include a twist that extends along its length. In the illustrated embodiment, the armrest 50A-B cross-section is an equilateral triangle. However, other embodiments may have triangular cross-sections characterized as isosceles triangles or scalene triangles. In some embodiments, the armrest cross-sections may be characterized as obtuse triangles, and it is believed that triangular armrests with an angle greater than 90 degrees may enhance the strength of the armrest. The substantially triangular-shaped cross-section of the armrests can be varied to adjust the strength of the chair as well as the desired appearance.

As illustrated in FIGS. 1-3, the armrests 50A-B are secured to the outside surfaces of respective rear legs 20A-B at one end and secured to the second ends 14 A-B of respective front legs 10A-B at the opposite ends. FIG. 4 illustrates the attachment of armrest 50B to the rear leg 20B. As shown, the substantially triangular cross-section of the armrest 50B includes a mounting surface 52, a support surface 54 and a connecting surface 56. The mounting surface 52 engages respective the front leg 10B and respective rear leg 20B, while the support surface is configured to provide support to an occupant's arm.

The mounting surface 52 is disposed adjacent the rear leg 20B at a position space apart from and above the seat portion 30. The armrest 50B may be joined to the rear leg 20B using any known attachment technique such as joinery using dowels, dovetail joints, and screws with threaded inserts. The armrest 50A is similarly attached to respective rear leg 20A.

FIG. 5 illustrates the attachment of the front end of the armrest 50B to a respective front leg 10B. As illustrated, the second end 14B of the front leg 10B is configured to engage mounting surface 52, which is the same surface of the armrest's triangular cross-section engaged by the rear leg 20B. As a result of the twist imparted on the armrest, the mounting surface 52 of the armrest 50B proximate the rear leg 20B is oriented substantially parallel to a plane formed by the outer surface of the rear leg 20B, but is oriented at an inclined relative to this same plane proximate the front leg 10B. It should be understood that the support surface 54 and the connecting surface 56 likewise change orientation along the length of the armrest as a result of the twist.

In the illustrated embodiment, the second end 14B of the front leg 10B has an inclined surface oriented to engage the mounting surface 52 of the armrest 50B. The armrest 50B may terminate substantially flush with the front leg or may extend beyond the front leg.

In various embodiments, the width of the mounting surface 52 of the armrest 50B is substantially the same as the adjacent surface of the front leg 10B. By virtue of attaching the same side of the triangular armrest 50B to the inclined second end 14B of the front leg 10B, the triangular armrest 50B has a configuration whereby the support surface 54 slopes downward and faces away from the respective rear leg 20B proximate the rear leg 20B but then becomes flat as it approaches the front of the seating device proximate the front leg 10B. In various embodiments, the support surface 54 is substantially perpendicular to the longitudinal axis of the respective front leg proximate the front leg. This twisting configuration of the armrest support surface 54 has been found to provide improved comfort to the occupant. The contours of the armrest are consistent with the natural, relaxed position of the occupant's arm. The armrest 50A is similarly attached to the second end 14A of front leg 10A.

Unexpectedly, the armrest of the present invention can provide strong joinery. Indeed, embodiments of the present invention have met the standards of Business and Institutional Furniture Manufacturer's Association ("BIFMA"). While it was anticipated that embodiments of the present invention might not be as strong as a conventional chair having a quadrilateral armrest, BIFMA testing shows that a triangular armrest can have the requisite strength.

Embodiments of the present invention include any number of ways to upholster the seating device. For example, the seat portion may be completely or partially covered in upholstery. Additionally, the back portion may also be upholstered as shown in FIGS. 7A-C and 8A-C. The particular upholstery coverage chosen can be based on personal preference or certain design parameters.

FIGS. 6A-C illustrate a lounge chair in accordance with an embodiment of the present invention. As illustrated, this embodiment includes armrests having a triangular cross-section and a twist extending at least a portion of the length of the arm rest. Furthermore, the back and sides of the lounge chair are upholstered as well as the seat portion.

In various embodiments of the present invention, components of the seating device may be constructed of wood, bamboo, and molded plastic or other known structural materials. In various embodiments, the seating device may be made of a sustainable material. Sustainable materials may include molded plastic, certified wood, phenolic resins, bamboo, reclaimed agricultural fiber, plantation-grown coconut palms, composite material of burled wood, high density polyethylene, non-toxic co-polyester resin, and high pressure laminates made from recycled laminate scraps. These materials may allow the seating device to withstand significant use over a long duration of time while being environmentally friendly. It should be understood that embodiments of this invention could be manufactured of any material a user would finds suitable for the seating device.

Like the rest of the seating device, the upholstery may be made of a sustainable material. A material such as natural latex foam is a sustainable material that is ideal upholstery for a chair. Other sustainable upholstery materials are flame retardant textiles, compostable stretch fabrics, chrome-free leathers, organic leathers, compostable felt, sustainable textiles, cellulose fabric, post-consumer recycled polyester, hemp and polymer-blended textiles. Useful examples of these upholstery materials include those marketed under the following trade names: Climatex® LifeguardFR™, Q Collection 2005 Climatex Collection®, Climatex® Lifecycle™Natural Stretch, Ecco-La leather, Sustana® leather, Felt Climatex® Lifecycle™, LIFE (Low Impact for the Environment) Textiles®, and Terratex™.

FIG. 9 illustrates a stack of seating devices 10 in accordance with an embodiment of the present invention. The open spaces between the armrest 50A-B and the seat portion 30 allows for the seating devices 10 to be stack. That is, the seating devices 10 are constructed so that the components of one seating device form a recess into which components of the other seating device project and fit in telescopic relation to form a storage stack. When stacked, the seat portions 30 are disposed on top of one another, while the front legs 10A-B and rear legs 20A-B are disposed through the open space below the armrests 50A-B, and the back portions 40. Various embodiments of the seating devices are able to stack independent of whether they are upholstered or whether the back is comprised of slats. The ability to stack the seating devices reduces the amount of storage needed when the seating devices are not in use, as well as facilitates movement of the seating devices from one location to another.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A seating device comprising:

a pair of front legs;

a pair of rear legs;

a seat portion mounted to the pairs of front legs and rear legs;

a back disposed between the pair of rear legs; and at least one armrest attached proximate a first end to a respective front leg, selected from the pair of front legs and attached proximate a second end to a respective rear leg, selected from the pair of rear legs, the armrest having a triangular cross-section and a twist extending the length of the armrest such that an arm support surface configured to support the arm of an occupant has a first orientation proximate the respective rear leg and a second orientation proximate the respective front leg, and wherein the first orientation comprises the support surface facing away from the respective rear leg and inclined relative to the respective rear leg, wherein the armrest includes a mounting surface that is disposed adjacent the respective rear leg proximate the second end and wherein the mounting surface is disposed against a terminal end of a respective front leg proximate the first end, and wherein the mounting surface of the armrest proximate the second end is oriented substantially parallel with respect to a plane formed by the rear leg and wherein the mounting surface proximate the first end is inclined relative to the plane as a result of the twist.

2. The seating device of claim 1, wherein the seating device comprises two armrests and the two armrests are secured to respective front and rear legs.

3. The seating device of claim 1, wherein the support surface is substantially perpendicular to a plane extending through a longitudinal axis of the respective front leg proximate the second end.

4. The seating device of claim 1, wherein the second orientation of the support surface is substantially parallel to a plane created by the seat section.

5. The seating device of claim 1, wherein the cross-section of the armrest is an equilateral triangle.

6. The seating device of claim 1, wherein the cross-section of the armrest is an obtuse triangle.

7. The seating device of claim 1, wherein the back tilts away from the seat portion.

8. The seating device of claim 1, wherein the back comprises one or more slats mounted between the pair of rear legs.

9. The seating device of claim 1, wherein the back is disposed proximate the seat portion.

10. The seating device of claim 1, further comprising upholstery covering the back and seat portions.

11. The seating device of claim 1, wherein the occupant-supporting side of the seat portion and back portion is upholstered.

12. The seating device of claim 10, wherein the upholstery comprises a sustainable material.

13. The seating device of claim 1, wherein the seating device is made of a sustainable material.

14. The seating device of claim 1, wherein the device is constructed to form a recess into which a second seating device fits in telescopic relation to form a storage stack.

15. A seating device comprising:

a pair of front legs;

a pair of rear legs;

a seat portion mounted to the pairs of front legs and rear legs;

a back disposed between the pair of rear legs; and at least one armrest attached proximate a first end to a respective front leg, selected from the pair of front legs and attached proximate a second end to a respective rear leg, selected from the pair of rear legs, the armrest having an arm support surface configured to support the arm of an occupant, wherein the support surface includes a twist such that the support surface has a first orientation proximate the respective rear leg and a second orientation proximate the respective front leg, and wherein the first orientation comprises the support surface facing away from the respective rear leg and inclined relative to the respective rear leg, wherein the armrest includes a mounting surface that is disposed adjacent the respective rear leg proximate the second end and wherein the mounting surface is disposed against a terminal end of a respective front leg proximate the first end, and wherein the mounting surface of the armrest proximate the second end is oriented substantially parallel with respect to a plane formed by the rear leg and wherein the mounting surface proximate the first end is inclined relative to the plane as a result of the twist.

* * * * *